United States Patent [19]

Backe et al.

[11] 4,394,965

[45] Jul. 26, 1983

[54] PULSATING SHOWER USING A SWIRL CHAMBER

[75] Inventors: Wolfgang Backe; Wolf-Dieter Goedecke; Reinhard Schwenzer, all of Aachen, Fed. Rep. of Germany

[73] Assignee: Friedrich Grohe Armaturenfabrik GmbH & Co., Hemer, Fed. Rep. of Germany

[21] Appl. No.: 264,563

[22] Filed: May 18, 1981

[30] Foreign Application Priority Data

May 17, 1980 [DE] Fed. Rep. of Germany ..... 3018917

[51] Int. Cl.[3] ..... B05B 3/14

[52] U.S. Cl. ..... 239/102; 239/403

[58] Field of Search ..... 239/102, 463, 466, 472, 239/478, 403; 137/808, 812, 835

[56] References Cited

U.S. PATENT DOCUMENTS

| | | | |
|---|---|---|---|
| 2,878,066 | 3/1959 | Erwin | 239/463 X |
| 3,182,675 | 5/1965 | Zilberfarb | 137/808 |
| 3,563,462 | 2/1971 | Bauer | 239/102 |
| 3,967,783 | 7/1976 | Halsted | 239/102 |

FOREIGN PATENT DOCUMENTS

| | | | |
|---|---|---|---|
| 533833 | 12/1954 | Belgium | 239/472 |
| 332438 | 10/1918 | Fed. Rep. of Germany | 239/472 |

*Primary Examiner*—John J. Love
*Assistant Examiner*—Paul A. Sobel
*Attorney, Agent, or Firm*—James B. Raden; Donald J. Lenkszus

[57] ABSTRACT

A shower head which provides a pulsating output utilizes a swirl chamber to impart a swirl to the water flow. The use of water driven parts is thereby eliminated.

5 Claims, 8 Drawing Figures

PULSATING SHOWER USING A SWIRL CHAMBER

BACKGROUND OF THE INVENTION

This invention pertains to a shower fixture having a swirl chamber located in the shower head to impart a swirl to the inflowing liquid. A shower fixture of this type is described in DE-PS No. 909 919 in which a bell-shaped housing is divided by means of partitions into an antechamber adjoining the inlet socket and a swirl chamber issuing into a central outlet nozzle. In the partition in the outer edge region there are one or more passages which impart a circular motion to the liquid passing through in the swirl chamber. This liquid subsequently emerges from the central outlet nozzle in an atomizing or spray jet. By providing deflectors it should additionally be possible to periodically intensify the water pressure in the swirl chamber. These variations are intended to impose themselves on the jet emerging from the central nozzle in the form of surges or "water hammer" so as to achieve a massage effect. However, a clearly defined pulsating shower jet which rotates a circular path at a definite frequency cannot be produced with this known device. It is therefore common practice in pulsating showers to utilize a rotor driven by a water jet. The rotor consecutively blanks off a section of shower jet nozzles arranged in annular fashion and as a result produces a circulating or pulsating shower jet pattern. These systems with water driven rotors are however on the one hand relatively costly and complicated to manufacture and on the other hand are prone to blockage by lime sediment and dirt particles.

It is also known practice to incorporate in shower a fluid oscillator with which is binary mode a water jet is produced which oscillates backward and forward between two positions. A rotatory outlet flow as is the case with the known rotor systems cannot however be achieved by these means.

SUMMARY OF THE INVENTION

One object of the invention is to provide a pulsating shower without components driven by water with which a shower jet pattern can be produced which rotates around a circular path at a definite frequency. Another object of the invention is to design a pulsating shower so as to permit changeover from pulsating shower jets to normal constantly emerging shower jets.

In an embodiment of the invention a pulsating shower includes a swirl chamber located in the shower head for imparting a swirl to the inflowing liquid. The swirl chamber is of approximately cylindrical shape, has an inlet positioned centrally along its center axis for a supply jet, and has on its downstream end face outlet openings positioned along a pitch circle concentric with the center axis.

In accordance with the principles of the invention it is possible to form a rotationally symmetrical wall jet element whose supply jet is caused to assume circulating rotary movement by means of angular momentum so that in the pulsating mode shower jets are produced at a semicircle of the circular positioned outlet openings.

The semicircle includes approximately 50% of the outlet openings and this semi-circle moves progressively round. Malfunctions resulting from dirt and/or lime sediment from the water etc. can to a large extent be prevented as the pulsating shower consists solely of a swirl or pulsation chamber with relatively large inlet and outlet openings. Parts moved by the flowing fluid are not necessary. By optionally imparting swirl to the supply flow in the swirl chamber it is possible to determine the rotational frequency of the shower jet pattern. If swirl is not imparted to the supply jet it is alternatively possible for constant normal shower jet to be produced by the entire circle of outlet openings. By means of a manually operated control element for imparting swirl in the vicinity of the swirl chamber it is possible quite simply to use the shower both as pulsating and as normal shower.

Further, in accordance with the principles of the invention, a control flow may be taken off upstream from the supply pipe and introduced tangentially through the cylindrical surface into the swirl chamber to impart swirl to the supply jet entering at the end face along the center axis whereby an interposed regulating and shut off valve will permit changeover from pulsating to normal shower and vice versa.

Further in accordance with the invention, instead of a control flow, preswirling of the supply jet can also take place in the vicinity of the inlet opening with the aid of a diffuser. It thus being possible to achieve rotary movement of the supply jet adjacent to the wall of the swirl chamber.

Still, further in accordance with the invention, preswirling of the supply jet may be provided in addition to tangential introduction of a control jet to further accentuate the pulsating action of the shower jets.

BRIEF DESCRIPTION OF THE DRAWINGS

The invention may be better understood from a reading of the following detailed description in conjunction with the drawings in which.

DETAILED DESCRIPTION

Figure 1:
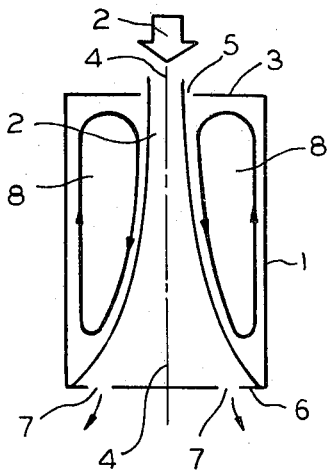
FIG. 1 shows a diagrammatical representation of a swirl chamber in normal shower mode.

For the sake of simplicity in the various design examples of the drawing the same or equivalent elements have been numbered identically.

FIGS. 1 to 4 first of all show in diagrammatic form the basic action of a swirl chamber 1.

Figure 2:
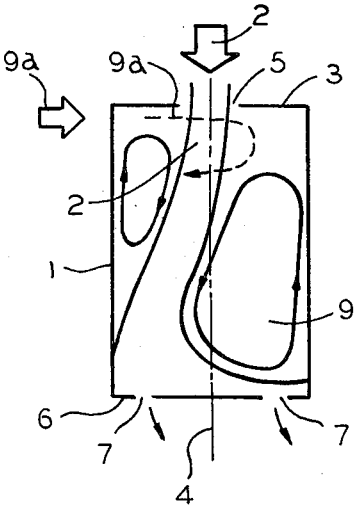
FIG. 2 shows the swirl chamber of FIG. 1 in pulsating mode.

The swirl chamber is of approximately cylindrical design and has two flat end faces. On the upstream end face 3 along the center axis 4 there is an inlet opening 5 for a supply jet 2. On the downstream end face 6 outlet openings 7 are provided around a single pitch circle. If now a supply jet 2 is introduced at inlet opening 5, ambient medium will be entrained at the boundary surfaces of the jet by frictional action so that a vortexlike secondary flow 8 is formed. With this flow situation as shown in FIG. 1 a symmetrical formation of jets emerges from outlet openings 7, i.e. a steady normal shower jet. With suitably extended design of the swirl chamber 1, with flow asymmetries *9a*, for example swirl, the supply jet is deflected slightly towards the wall; thus at this point constriction of the vortical flow occurs and as a result of the consequent increased flow velocities a reduction in the static pressure takes place which in turn leads to an increase in jet deflection (wall jet effect) so that finally the supply jet 2 under the effect of a support eddy 9 is completely adjacent to the wall as FIG. 2 shows. In addition as a result of the friction phenomena the supply jet 2 steadily expands on flowing through the swirl chamber and at the downstream end face 6 occupies more than one third of the chamber cross sectional area. The wall jet effect is additionally assisted thereby.

With short swirl chamber lengths (length/diameter less than 2) the above-mentioned effect is no longer sufficient to deflect the supply jet 2 to the chamber wall as the resultant pressure gradient is in turn partially compensated for by the returning secondary flow 8 deflected on the housing bottom. In this case in static condition the supply jet 2 flows symmetrically out of the annular positioned outlet openings and thus produces constant shower jets of a normal shower.

If however one introduces a control flow tangentially into the chamber, in the event of asymmetry, in addition to the wall jet effect (coanda effect) the constriction of the control flow also acts on the pressure gradient in the pulsation chamber. With a control flow of sufficient magnitude, as a result of superimposing the two forces, even with relatively short lengths (length-/diameter = 1.5) of swirl chamber 1, a sudden contact of the supply flow with the chamber wall also occurs. Carried along by the tangentially introduced control flow, the supply jet adhering to the wall together with the secondary flow 8, 9 describes a rotary movement as a result of which a circulating outlet flow, i.e. pulsation of the shower jets is caused.

By incorporating a shut off and regulating device in the control flow it is possible to change the shower fixture over from normal shower to pulsating shower and vice versa. By reducing or increasing the control flow it is possible to set the rotational frequency of the shower jets as required.

Figure 3:
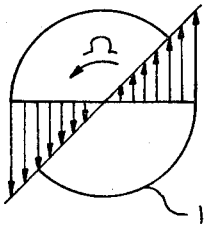
FIG. 3 shows a cross-section of the swirl chamber in accordance with FIG. 2 with diagrammatically represented velocity distribution.
Figure 4:
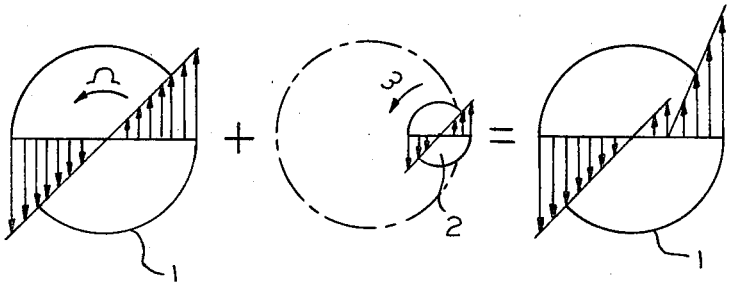
FIG. 4 shows the swirl chamber as per FIG. 3 with diagrammatically represented velocity distribution with pre-swirled supply jet.

Circulating wall adhesion of the supply jet 2 can also be achieved by pre-swirling. Here it has been found that the swirl chamber length can be reduced approximately to a length/diameter ratio of 1 if the supply jet 2 is additionally pre-swirled in the vicinity of inlet opening 5 and in addition a tangential control flow is introduced. FIG. 3 shows in a diagrammatical form the velocity distribution in swirl chamber 1 with unswirled supply jet 2. As the flow rotates at a constant angular velocity, the tangential flow velocity in the chamber increases in linear proportion with the radius. With a supply jet 2 where swirl has been induced, as a result of superimposing the internal and external angular velocities and the resultant flow shown in FIG. 4 occurs with a considerably higher velocity and thus as well pressure gradient. The supply jet can as a result still be in contact with the wall even with very short swirl chamber lengths.

The supply jet 2 described above contacting the side wall of the swirl chamber 1 breaks down on striking the downstream end face 6 and is distributed almost uniformly over the individual outlet openings 7. The asymmetry of the outlet opening necessary to achieve circulating discharge flow is brought about essentially by the differing directions of discharge of the individual jets, caused by the wall adhesion effect in the chamber. By varying size and arrangement of the outlet openings it is possible to vary the jet pattern thus produced over a wide range and to suit it to specific requirements in each case. The pulsation frequency can be varied over a wide range by means of the control flow and/or by means of a swirl imparted to the supply jet. the pulsation frequency f will be reduced with increasing radius r of the swirl chamber 1 as the power to be applied by the control flow to accelerate the supply flow Q along a circular path is approximately proportionate to $Q \times r^2 \times f^2$.

Figure 5:
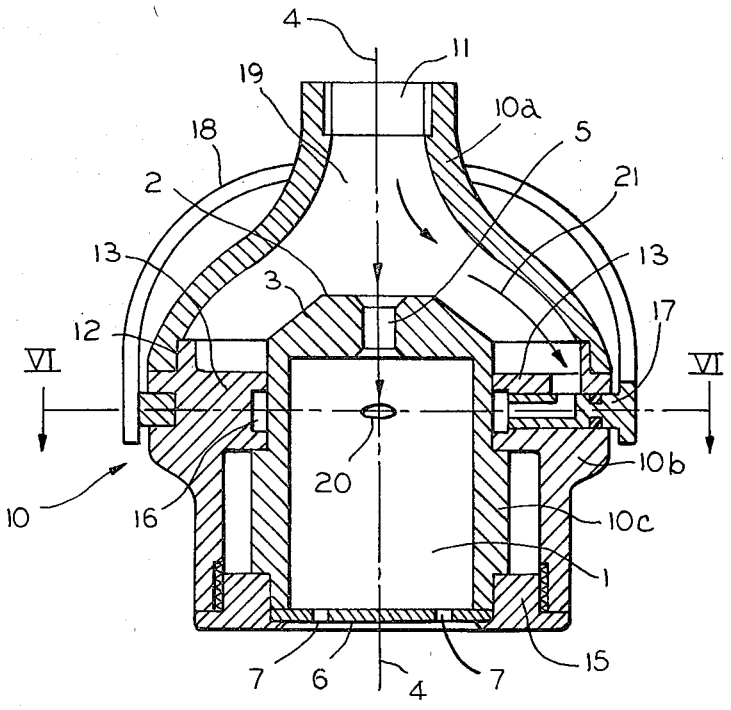
FIG. 5 shows an adequate wall shower in longitudinal section.
Figure 6:
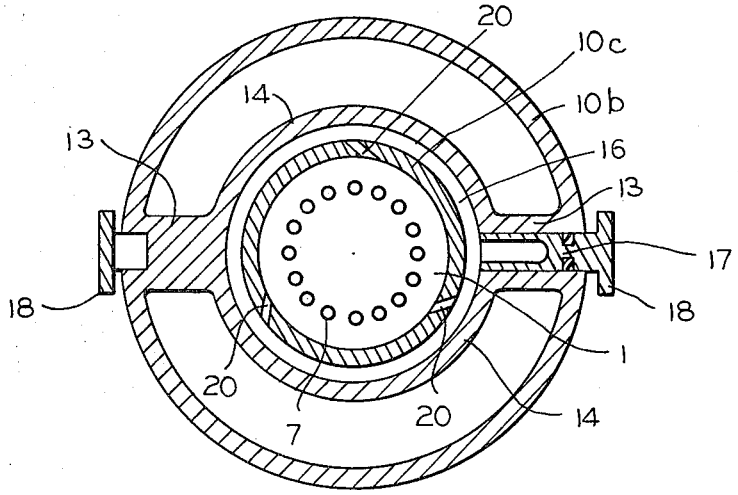
FIG. 6 shows a section through the wall shower of FIG. 5 along plane VI.

In FIGS. 5 and 6 the swirl chamber 1 described in principle above is located in an adjustable wall shower. In a two-part housing 10 swirl chamber is located along center axis 4. The upstream housing section **10*a* has a connection socket 11 for the supply pipe and downstream is tightly connected by screw thread 12 to a bottom housing section 10*b* in which is secured a hollow cylinder 10*c* which encompasses swirl chamber 1. The bottom housing section 10*b* is essentially cylindrical in form and at the top has a concentric ring element 14 supported by two ribs 13 by which hollow cylinder 10*c* is encompassed at the top. At the bottom hollow cylinder 10*c* is secured by a nut 15 which also supports the downstream end face 6 if swirl chamber 1** which at the same time takes the form of a shower bottom.

Around the inside wall of ring element 14 runs an annular passage 16 which is joined to supply chamber 19 enclosed by the top housing section **10*a* by means of a tap valve 17 operated with a bar 18. At the level of annular passage 16 there are in the wall of hollow cylinder 10*c* three tangential inlet openings 20 for introduction of the control flow into swirl chamber 1. In the upstream end face 3 of swirl chamber 1, coaxial to center axis 4, there is an inlet opening 5 or inlet nozzle for supply jet 2. Swirl chamber 1** has a length/diameter ratio of approximately 1.3.

In the position of bar 18 shown in FIG. 5 the shower liquid enters the top housing section **10*a* in the vicinity of connection socket 11 in the direction shown by the arrow and here is split up in supply chamber 19 into a supply jet 2 and a control flow 21. As a result of the combined action of the supply jet 2 emerging coaxially along center axis 4 and the control flow 21 introduced tangentially in the top of the wall of hollow cylinder 10*c* a circulating wall jet in contact with the wall is produced in swirl chamber 1 which emits circulating or pulsating shower jets through the outlet openings 7** located around a single pitch circle.

If now bar 18 is swivelled round, passage through tap valve 17 is prevented so that as a result of the relatively short design of swirl chamber 1 the supply jet 2 is no longer deflected on to the wall but impinges on the downstream end face 6 symmetrically with center axis 4 and is emitted through all the outlet openings 7 in the form of continuous shower jets of a normal shower.

By optionally restricting control flow 21 with the aid of tap valve 17 it is also possible to vary the rotational frequency of the pulsating shower jet emitted.

Figure 7:
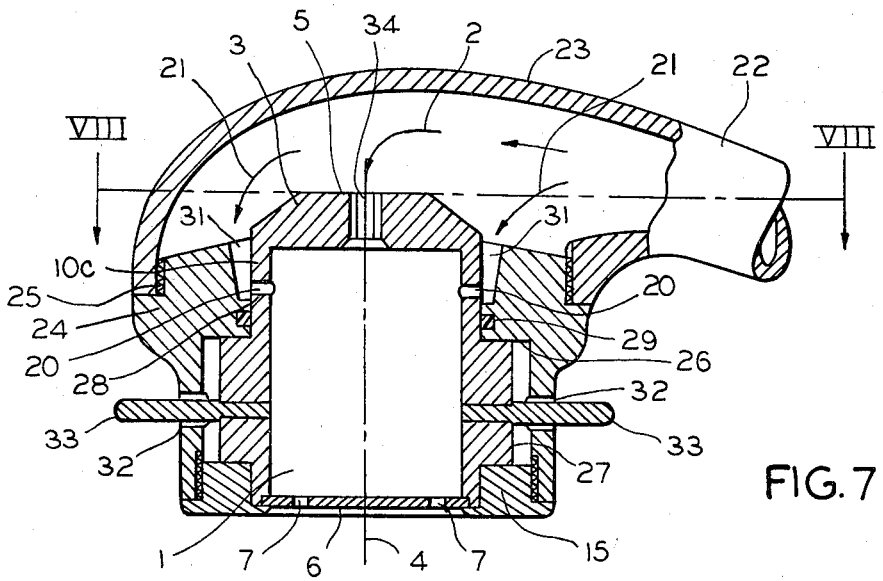
FIG. 7 shows a partially longitudinally sectioned adjustable hand shower.
Figure 8:
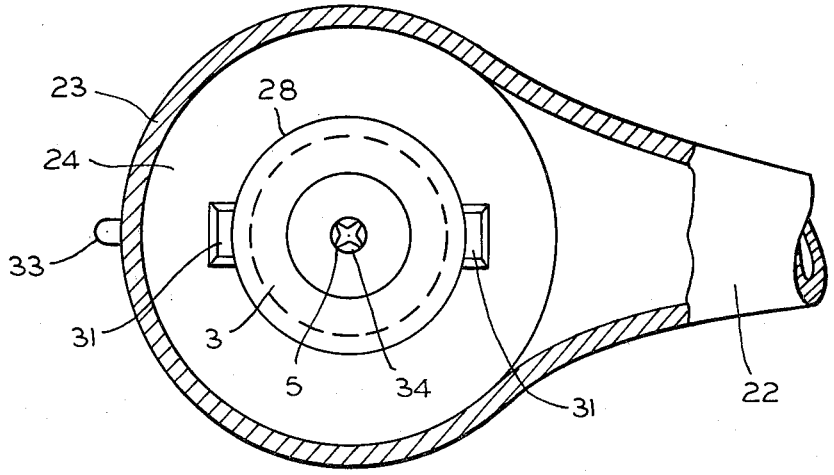
FIG. 8 shows a section through the hand shower of FIG. 7 along plane VIII.

FIGS. 7 and 8 show another design example of the invention in the form of a hand shower. On a hand shower handle 22 on the downstream end is formed a housing top section 23 in which a housing bottom section 24 is secured by screw connection 25 so as to provide a water tight seal. In housing bottom section 24 which is of approximately rotationally symmetrical design a hollow cylinder 10c surrounding the cylindrical swirl chamber 1 is secured along the center axis 4 so as to permit limited rotation. Here hollow cylinder 10c is secured so as to be fixed axially with a nut 15 to be screwed in downstream in housing bottom section 24 with the aid of a collar 27 against a shoulder 26. The upstream portion of hollow cylinder 10c is rotatably located by a cylindrical hole 28, sealed with an O-ring 29. Above O-ring 29 there are two opposite tangential inlet openings 20 for control flow 21. Parallel to center axis 4 at the level of inlet openings 20 in the wall of hole 28 there is in each case an inlet slot 31 connected to housing top section 23. To swivel hollow cylinder 10c pins 33 are provided which project out of the shower and are located in slots 32 to permit limited swivel movement. With the aid of pins 33 hollow cylinder 10c can be rotated by hand as required in housing bottom section 24 from a setting where inlet openings 20 are in alignment with inlet slots 31 to a position where they are fully separated from one another.

The principle of operation of this hand shower is basically the same as that described for FIGS. 5 and 6. For proper conduction of liquid however inlet opening 5 in upstream end face 3 is provided with a deflector device 34 so that in spite of radial flow of the shower liquid a properly concentrated supply jet 2 is obtained. The control flow 21 enters inlet slots 31 parallel to the supply stream on both sides and passes into swirl chamber 1 to the extent required in keeping with the rotational setting. Dependent on the rotational setting of the swirl chamber or of hollow cylinder 10c therefore it is possible to produce either a pulsating jet or a continuous normal shower jet.

What is claimed is:

1. A shower fixture connected to a fluid supply, said shower fixture comprising:

a swirl chamber, said swirl chamber being of approximately cylindrical shape and having a central longitudinal axis, said chamber having an upstream end face, said upstream end face having an inlet opening, said inlet opening being positioned on said central longitudinal axis and in fluid communication with said fluid supply to provide a supply jet, said swirl chamber having a downstream end face having a plurality of outlet apertures arranged along a pitch circle, said pitch circle being concentric with said central longitudinal axis, and means for generating a control flow, said control flow means comprising one or more tangentially located inlet apertures in the wall of said swirl chamber, said inlet apertures being located near said upstream end face.

2. A shower fixture in accordance with claim 1, wherein said control flow means includes a fluid passage between said one or more tangentially located inlet openings and said fluid supply upstream of said swirl chamber; and a control valve in said fluid passage.

3. A shower fixture in accordance with claim 2, wherein said shower fixture comprises a housing, and said swirl chamber is formed by a hollow cylinder.

4. A shower fixture in accordance with claims 1 or 2 wherein said control flow means comprises an annular passage around said swirl chamber in communication with said one or more tangentially located inlet openings, and said control valve comprises a tap valve positioned radially to said swirl chamber and in communication with said annular passage.

5. A shower fixture in accordance with claim 3, wherein said housing includes a bottom portion, said hollow cylinder being mounted axially in said bottom portion and capable of rotary movement; said fluid passage comprises one or more slots in said housing adjacent to said hollow cylinder, each of said slots providing fluid communication to a corresponding one of said one or more tangentially located inlet openings, whereby the rotational position rotation of said hollow cylinder determines the through flow cross-section each one of said inlet openings presents to the corresponding one of said slots.

* * * * *